US009359132B2

(12) United States Patent
Sullinger et al.

(10) Patent No.: US 9,359,132 B2
(45) Date of Patent: Jun. 7, 2016

(54) LINER SUMP DISPENSING SYSTEM

(71) Applicant: Grayling Industries, Inc., Alpharetta, GA (US)

(72) Inventors: Randy R. Sullinger, Columbia, MO (US); Tony R. McKee, Dover, DE (US)

(73) Assignee: Grayling Industries, Inc., Alpharetta, GA (US)

( * ) Notice: Subject to any disclaimer, the term of this patent is extended or adjusted under 35 U.S.C. 154(b) by 144 days.

(21) Appl. No.: 14/247,464

(22) Filed: Apr. 8, 2014

(65) Prior Publication Data

US 2015/0284181 A1 Oct. 8, 2015

(51) Int. Cl.

| | |
|---|---|
| ***B67D 7/84*** | (2010.01) |
| ***B65D 88/60*** | (2006.01) |
| ***B65D 77/06*** | (2006.01) |

(52) U.S. Cl.

CPC ..... *B65D 88/60* (2013.01); *B65D 77/061* (2013.01); *B65D 2231/008* (2013.01)

(58) Field of Classification Search

CPC ..... B65D 88/60; B65D 88/56; B65D 88/62; B65D 77/06; B65D 77/061; B65D 2231/008; B65G 65/23

USPC ..... 222/164

See application file for complete search history.

(56) References Cited

U.S. PATENT DOCUMENTS

| | | | | | |
|---|---|---|---|---|---|
| 3,198,395 | A * | 8/1965 | McKinney | B65D 88/56 | 141/284 |
| 4,720,232 | A * | 1/1988 | Williams | B65D 88/56 | 414/424 |
| 4,838,443 | A * | 6/1989 | Cripe | B65D 88/56 | 220/1.5 |
| 5,344,048 | A * | 9/1994 | Bonerb | B65B 69/0075 | 222/105 |
| 5,437,384 | A * | 8/1995 | Farrell | B65D 19/12 | 220/1.5 |
| 5,765,723 | A | 6/1998 | Wilcox | | |
| 5,788,449 | A | 8/1998 | Riemersma | | |
| 5,944,470 | A * | 8/1999 | Bonerb | B65B 69/0091 | 222/166 |
| 6,120,181 | A | 9/2000 | Wilcox | | |
| 6,158,623 | A * | 12/2000 | Benavides | B65D 83/06 | 222/129 |
| 6,234,351 | B1 | 5/2001 | Wilcox | | |
| 6,379,034 | B1 * | 4/2002 | Schutz | B65G 65/23 | 222/166 |
| 6,427,873 | B2 | 8/2002 | Wilcox | | |
| 6,467,652 | B2 | 10/2002 | Wilcox et al. | | |
| 2009/0202325 | A1 * | 8/2009 | Wahls | B65G 65/23 | 414/293 |
| 2015/0023769 | A1 * | 1/2015 | Oberg | B65G 65/23 | 414/299 |

* cited by examiner

*Primary Examiner* — Patrick M Buechner
*Assistant Examiner* — Jeremy W Carroll
(74) *Attorney, Agent, or Firm* — Baker Donelson; Dorian Kennedy

(57) ABSTRACT

A liner sump dispensing system (10) is disclosed which is used in conjunction with a liner (11) and an intermediate bulk container (12). The liner sump dispensing system includes a liner cassette (40) and a tilting device (41). The liner cassette is mounted to the bottom of the liner. The tilting device includes a tray (51) and a reciprocating pneumatic arm (52) having a pneumatic cylinder (63) and a piston rod (64) pivotally coupled to a rear end (54) of the tray. The tray has a trapezoidal shaped floor (58) and a pair of inclined wings (60) extending upwardly along an incline from the floor. A L-shaped mounting flange (65) adapted to be coupled to the top end of the container is coupled to the end of the pneumatic cylinder opposite from the tray. The actuation of the pneumatic cylinder tilts the tray to tilt the liner bottom end.

20 Claims, 3 Drawing Sheets

LINER SUMP DISPENSING SYSTEM

TECHNICAL FIELD

This invention relates to bulk material liners used in conjunction with bulk containers, and particularly to a sump dispensing system used in conjunction with intermediate bulk container liners.

BACKGROUND OF THE INVENTION

Flexible liners are oftentimes utilized in conjunction with an intermediate bulk container or bag to ship large quantities of liquid, viscous or granular products. A problem long associated with the use of such liners has been the complete or near-complete evacuation of the contents from within the liner. As such, some liners have included pressurized regions to lift or angle the bottom of the liner in order to move the contents closer to the outlet of the liner. While these devices have aided in the evacuation of the liner they can still result in rather large quantities of content remaining within the liner.

Devices have also been used to lift or tilt the liner to aid in the dispensement of the contents. These devices may tilt the entire liner, as shown in U.S. Pat. No. 5,944,470, or may tilt only the floor of the liner, as shown in U.S. Pat. No. 5,788,449. These devices have proved to be difficult to use due to the massive weight of a filled liner.

Accordingly, it is seen that a need remains for an intermediate bulk container liner dispensing system that can more efficiently evacuate the contents. It is to the provision of such therefore that the present invention is primarily directed.

SUMMARY OF THE INVENTION

A liner sump dispensing system for use with a liner having a bottom wall and sidewalls and an intermediate bulk material container having a floor and sidewalls extending upwardly from the floor, the liner sump dispensing system comprises a tray configured to be positioned between the intermediate bulk material container floor and the liner bottom wall, and a powered linear reciprocating arm having a first end coupled to an end of the tray and a second end adapted to be coupled closely adjacent to a top end of a sidewall of the intermediate bulk material container. With this construction, the actuation of the powered linear reciprocating arm causes the raising of the one end of the tray so as to tilt the trey and the liner thereon.

DETAILED DESCRIPTION

Figure 1:
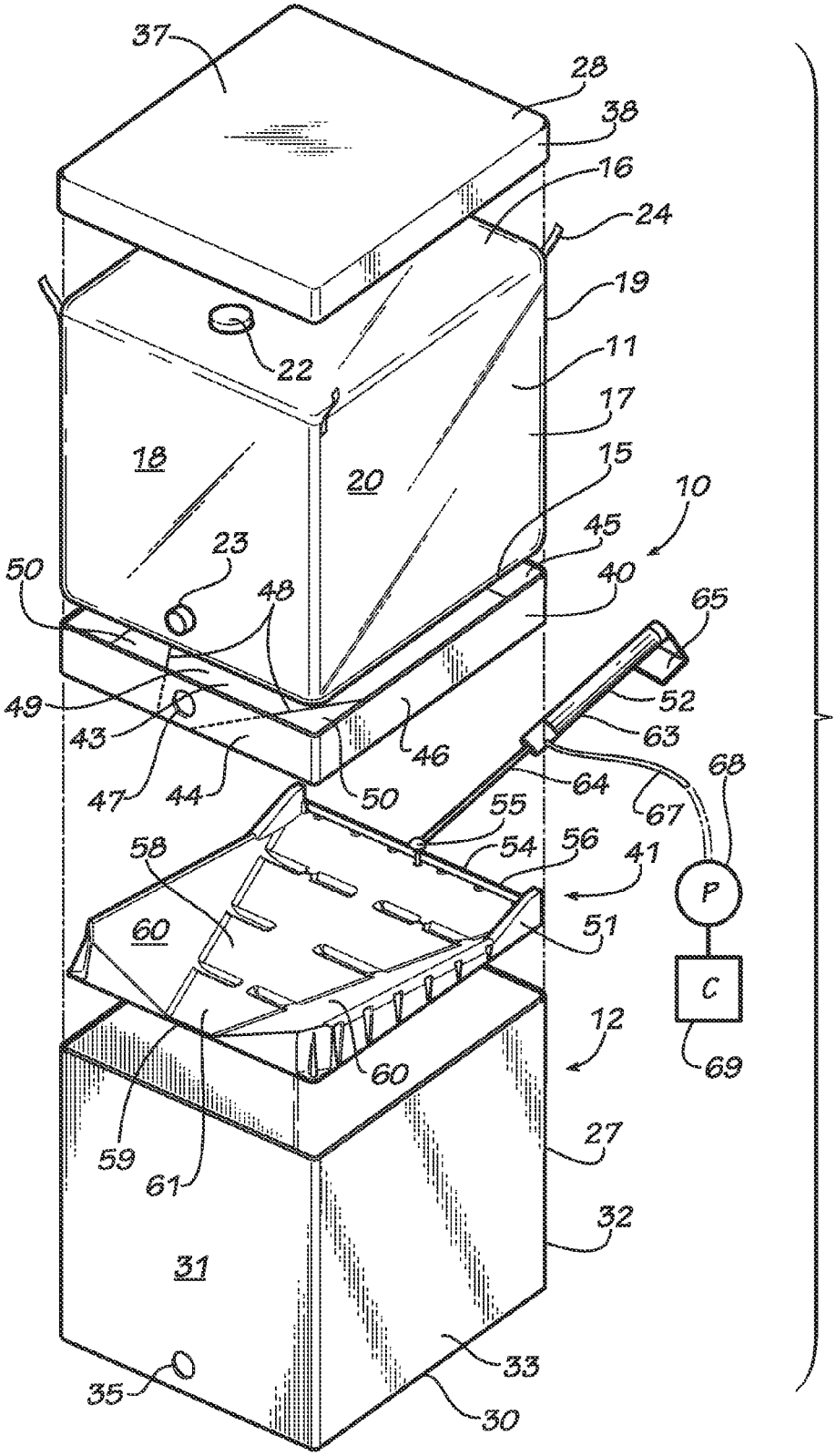
FIG. 1 is a perspective, exploded view of a liner sump dispensing system embodying principles of the invention in a preferred form, shown with a liner and intermediate bulk container.

With reference next to the drawings, there is shown a liner sump dispensing system 10 embodying principles of the invention in a preferred form. The liner sump dispensing system liner 10 is configured to be used in conjunction with a conventional plastic film, flexible liner 11 and a conventional intermediate bulk container 12. The bulk container 12 is in the form of a generally rigid container made of a plastic, cardboard, or paper material.

The liner 11 has the general configuration of a rectangular prism or cuboid, which may also be considered to be generally considered box-shaped. The liner 11 has a bottom wall 15, a top wall opposite the bottom wall 15, and four side walls 17 extending between the bottom wall 15 and top wall 16. The four side walls 17 include a front wall 18, a rear wall 19, and two oppositely disposed end walls 20. The top wall 16 includes a top opening fitment 22 through which bulk material or content may be passed through and into the liner. The front wall 18 may include an exit or dispensing opening fitment 23 positioned closely adjacent the bottom wall 15 through which the bulk material or content may exit the liner should the liner be configured as a bottom dispensing liner. Should the liner not include the dispensing opening fitment 23, then the liner is considered to be a top dispensing liner wherein a suction tube, pipe, or wand is inserted into the top fitment 22 to extract the material through a suction device or system coupled to the suction wand. The top corners of the liner 11 may be coupled to the top corners of the bulk container with ties 24 to keep the liner generally in position within the container.

The intermediate bulk container 12 is configured similarly to the liner 11 and is adapted to receive the liner 11 and liner sump dispensing system 10 therein. The container 12 includes a bin or bottom portion 27 and a lid 28 configured to fit upon the top end of the bin 27. The bin 27 has a bottom wall or floor 30, a front wall 31, a rear wall 32, and two oppositely disposed end walls 33. The front wall 31 may include a front opening 35 configured to receive the dispensing opening fitment 23 of the liner therein. The walls 31, 32, and 33 of the bin are of a size to contain the material within the liner without breaking or fracturing, as such they are extremely strong in nature and are capable of withstanding a great deal of force thereon. The lid 28 includes a top wall 37 and four downwardly extending side panels 38 which are configured to fit snugly about the top end of the bin.

The liner sump dispensing system 10 includes a liner cassette 40 and a tilting device 41. The liner cassette 40 includes a floor 43, a front panel 44, a rear panel 45, and two oppositely disposed end panels 46. The front panel 44 has a fitment opening 47 therein which is configured to receive the liner dispensing opening fitment 23 therethrough. The floor 43 includes a series of score lines or folds 48 which enable the floor to be bent or folded along these folds 48 to conform with the tilting device, as explained in more detail hereinafter. As can be seen in the drawings, the cassette floor 43 may be folded along the folds 48 to form a cassette central panel 49 and two oppositely disposed cassette wings and side panels 50 which can rise as they extends away from the cassette central panel. The cassette 40 is mounted to the bottom end of the liner 11 and is maintained in place with an adhesive or adhesive tape therebetween. The cassette 40 may be made of a cardboard, paperboard, plastic or other similar material.

The tilting device 41 includes a multi-faceted bottom tray or plate 51 and a linearly reciprocating pneumatic arm 52 pivotally coupled to a rear end 54 of the tray 51 through a multi-directional joint 55, such as a conventional, universal ball-joint. The tray rear end 54 is reinforced through an embedded metal bar 56 extending along the length of the rear end 54 to help strengthen the tray 51 in this area and especially to help strengthen the mounting of the multi-directional joint 55. The tray 51 has a generally trapezoidal shaped floor 58 having a front end 59 opposite the tray rear end 54 and a pair of inclined side panels or wings 60 extending upwardly along an incline from the floor 58. The floor 58 and wings 60 combine to form a trough or chute with a lowest area or sump 61 at the front end 59. It should be understood that the junction of the floor and wings generally aligns or coincides with the folds 48 of the cassette 40 so that the cassette 40 can conform to the shape of the tray upper surface when under pressure from the liner contents. The tray 51 may be made of a rigid plastic, metal or similar rigid material, as is preferably made of a 0.35 gauge high density polyethylene plastic.

The pneumatic arm 52 of the tilting device includes a pneumatic cylinder 63 and a piston rod 64 extending from the cylinder 63. A L-shaped mounting catch or flange 65 is coupled to the end of the pneumatic cylinder opposite from the multi-directional joint 55. The pneumatic arm 52 is coupled to conventional pneumatic equipment which includes a pressure line 67 coupled to the cylinder and a pump 68 and controller for controlling the pressurization of the cylinder 63 during use to force the piston inwardly to a retracted position within the cylinder. The system is intended to be actuated through a pressurization of approximately 40 p.s.i.

The pneumatic arm 52 has a cylinder stroke (distance of piston rod movement) of approximately 17 inches so that the total length of the pneumatic arm in an extended configuration is approximately 37 inches. This pneumatic arm configuration is intended to be utilized with a bulk container bin measuring approximately 42 inches by 45 inches by 40 inches.

Figure 2:
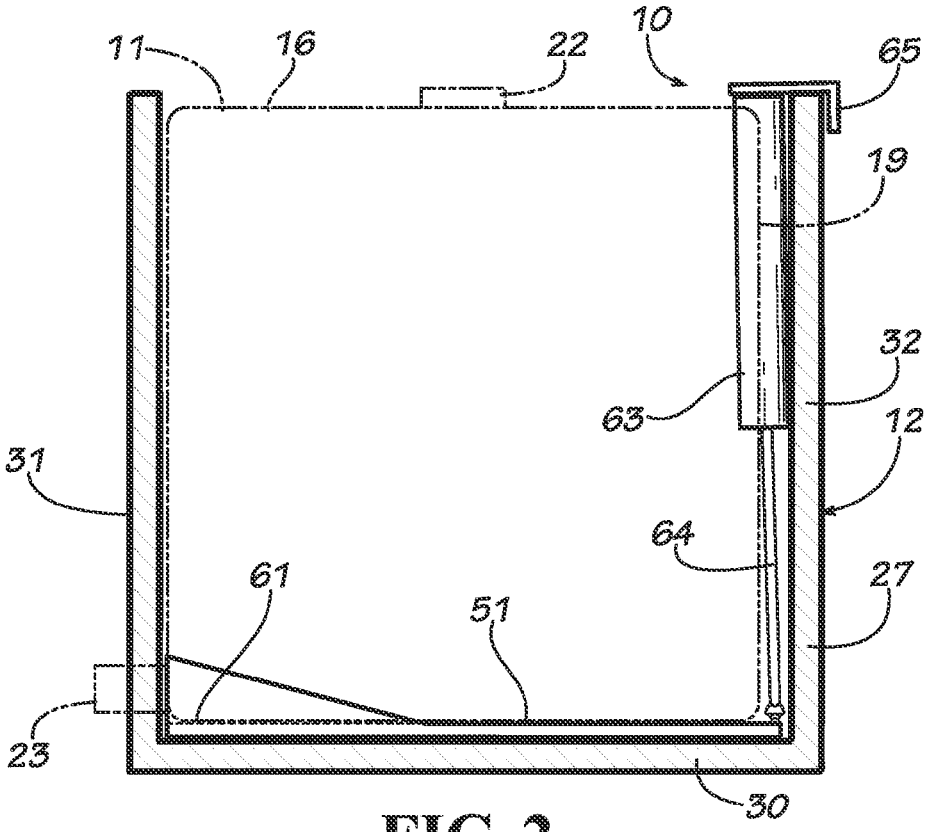
FIGS. 2-4 are a series of schematic side views of the liner sump dispensing system, liner and intermediate bulk container of FIG. 1.

In use, the liner sump dispensing system 10 is placed within the bin 27 of the bulk container 12 with the tray 51 positioned upon the bin floor 30 and the tray front end 59 positioned closely adjacent the bin front wall 31. The pneumatic arm 52 is then manually pivoted to a generally upright position closely adjacent to and along the bin rear wall 32 and the pneumatic arm mounting flange 65 is positioned over the top edge of the bin rear wall 32, as shown in FIG. 2.

With a cassette 40 adhered to the bottom portion of the liner 11 with the liner dispensing opening fitment 23 extending through the cassette fitment opening 47, the liner and cassette are lowered into the bin. The liner dispensing opening fitment 23 is positioned to extend through the bin front opening 35 in the front wall 31. It should be understood that the cassette prevents wrinkling of the liner which may cause a restriction in the volume of the liner and possible blockage during dispensement of the contents. The cassette folds 48 should coincide with the configuration of the top surface of the tray, i.e., the folds should be substantially aligned with the juncture of the tray floor 58 and wings 60 so that the cassette bends or folds to conform with the underlying tray once the weight of the contents commences to push downwardly upon the cassette. The liner top corners are then tied to the bin top corners through ties 24 to maintain the liner upright and expanded.

Material or contents to be shipped are then transported or poured into the liner through the liner top opening fitment until the desired amount is reached. It should be understood that the pneumatic arm pressure line 67 extends along the pneumatic arm between the liner and bin. The pressure line extra length extending past the liner is laid upon the top of the filled liner. The bulk container lid 28 is then placed upon the bin for transportation.

At the dispensement of content site, the lid 28 is removed from the bin 27 to expose the top of the liner and the pressure line 67 of the pneumatic arm 52. The pressure line 67 is then coupled to the controller 69 actuated pump 68 so that the cylinder 63 in under approximately 40 p.s.i. of pressure.

Figure 3:
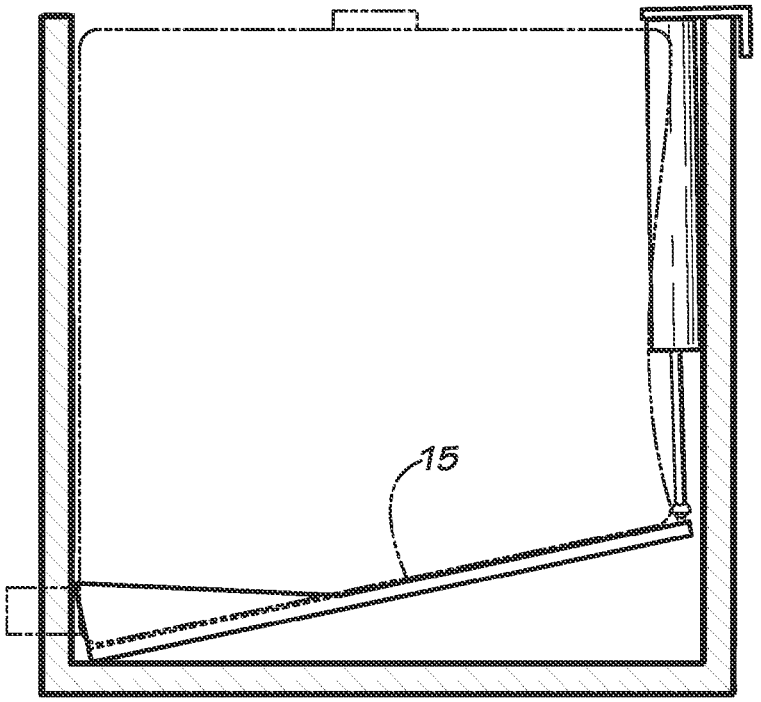
Figure 4:
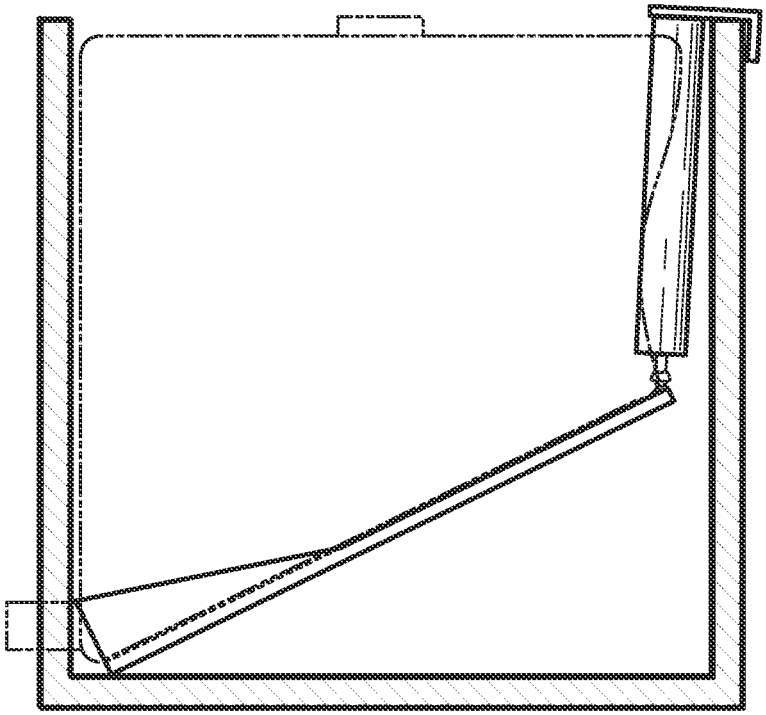

The liner dispensing opening fitment 23 is then opened so that the contents within the liner may gravitationally flow therethrough. Alternatively, a suction tube or hose may be coupled to the dispensing opening fitment 23 to aid in the extraction of dense material. As the content is dispensed from the liner the weight of the remaining content within the liner diminishes. When the content weight reaches approximately 200 to 300 pounds the pressure within the pneumatic arm cylinder 63 should overcome the weight of the content and the arm piston rod 64 commences to retract into the cylinder. The upward movement of the piston rod causes the rear end 54 of the tray 51 to commence tilting, lifting, or raising, as shown in FIG. 3. The raising of the tray causes the contents within the liner to gravitationally flow towards the tray front end 59 and the liner dispensing opening fitment 23. The configuration of the inclined wings 60 of the tray also cause the contents to flow towards the centerline of the tray and to the lowest portion of the tray, collection point, or sump until the piston is completely retracted, as shown in FIG. 4, which creates a tray angle of approximately 33 degrees with respect to the horizontal bin floor 30. The tilting of the tray and the sheeting action of the material caused by the tilting ensures that nearly all the contents gathers in the sump 9 and is expelled through the liner dispensing opening fitment 23.

It should be understood that the use of the cassette is optional, however, the advantage of the cassette is that it help in preventing the flexible liner and the contents therein undesirably from extending between the tray 51 and the bin 27. The cassette also aids in preventing wrinkling or folding of the liner material along its bottom wall 15 which could block the flow of contents or trap the contents within the folds.

Once the contents are evacuated from the liner the pump and controller are de-activated and the pressure line 67 is removed therefrom. Pressurized air within the pneumatic arm is expelled from the pressure line and the piston rod 64 moves downwardly to its extended position so that the tray once again lies flat upon the bin floor. The liner may then be removed from the bin 27.

It should be understood that the just described invention may also be utilized with a liner which does not include a dispensing opening fitment 23. Here, the liner is tilted by the liner sump dispensing system 10 so that the contents are concentrated in the area of the sump 61 to provide better evacuation by a suction tube inserted through the top opening fitment 22 to extract the contents.

It should be understood that as an alternative to the pneumatic cylinder shown in the preferred embodiment, the system may include a hydraulic cylinder. As such, as used herein the term fluid powered arm or system, or the like, is intended to include both pneumatic and hydraulic arms or systems. Furthermore, a linearly actuated electrically powered arm may also be utilized, as such, the system may use any powered reciprocating arm.

Lastly, it should be understood that the pneumatic arm 52 may be coupled to a cut-out, notch or other similar edge which does not constitute an actual top edge of the container, so long as it is coupled to an upper region of the container proximal the top end or edge of the container.

It thus is seen that a liner is now provided which overcomes problems associated with liners of the prior art. While this invention has been described in detail with particular references to the preferred embodiments thereof, it should be understood that many modifications, additions and deletions, in addition to those expressly recited, may be made thereto without departure from the spirit and scope of the invention.

The invention claimed is:

1. A liner sump dispensing system for use with a liner having a bottom wall and sidewalls and an intermediate bulk material container having a floor and sidewalls extending upwardly from the floor, said liner sump dispensing system comprising, a tray positioned between the intermediate bulk material container floor and the liner bottom wall, and a powered linear reciprocating arm having a first end coupled to an end of said tray and a second end having an intermediate bulk material container releasable catch adapted to be releasably coupled closely adjacent to a top end of a sidewall of the intermediate bulk material container, whereby the actuation of the powered linear reciprocating arm causes the raising of the one end of the tray so as to tilt the trey and the liner thereon.

2. The liner sump dispensing system of claim 1 wherein said powered linear reciprocating arm is coupled to said tray through a pivoting joint.

3. The liner sump dispensing system of claim 1 wherein said tray includes a floor and two oppositely disposed wings extending upwardly from said floor.

4. The liner sump dispensing system of claim 3 further comprising a cassette which receives a bottom end of said liner, and wherein said cassette includes a cassette floor central panel configured similarly to said tray floor and two oppositely disposed cassette wings configured similarly to said tray wings.

5. The liner sump dispensing system of claim 4 wherein said cassette includes a front panel having an cassette opening therethrough which receives the liner dispensing opening fitment.

6. The liner sump dispensing system of claim 1 wherein the liner includes a dispensing opening fitment positioned closely adjacent the liner bottom wall and the intermediate bulk material container has an opening closely adjacent the intermediate bulk material container floor which receives the dispensing opening fitment therethrough, and wherein said trey has a front end proximal the liner dispensing opening fitment and a rear end distal the liner dispensing opening fitment, and wherein said powered linear reciprocating arm is coupled to said tray at said tray rear end.

7. The liner sump dispensing system of claim 6 wherein said tray floor tapers as it extends towards said trey front end.

8. The liner sump dispensing system of claim 7 wherein said trey wings taper in height from a highest height proximal said tray front end to a lowest height proximal said tray rear end.

9. The liner sump dispensing system of claim 1 wherein said powered linear reciprocating arm second end includes a mounting flange which captures the intermediate bulk material container sidewall top end.

10. The liner sump dispensing system of claim 1 further comprising a cassette a which receives bottom end of said liner.

11. A liner sump dispensing system comprising, a liner having a liner bottom wall and liner sidewalls extending from said liner bottom wall;

a container having a container floor and container sidewalls extending upwardly from said container floor, said liner bottom wall generally conforming to said container floor and said liner sidewalls generally conforming to said generally planar container sidewalls;

a tray which overlays said container floor and generally underlay the liner bottom wall, and a linear reciprocating arm having a first portion coupled to an end of said tray and a second portion having an intermediate bulk material container releasable catch releasably coupled to an upper region of said generally planar container sidewall, whereby the actuation of the linear reciprocating arm causes the raising of the one end of the tray so as to tilt the liner thereon.

12. The liner sump dispensing system of claim 11 wherein said linear reciprocating arm is coupled to said tray through a pivoting joint.

13. The liner sump dispensing system of claim 11 wherein said tray includes a floor and two oppositely disposed wings extending upwardly from said floor.

14. The liner sump dispensing system of claim 13 further comprising a cassette which receives said liner bottom end, and wherein said cassette includes a cassette floor central panel configured similarly to said tray floor and two oppositely disposed cassette wings configured similarly to said tray wings.

15. The liner sump dispensing system of claim 14 wherein said cassette includes a front panel having an cassette opening therethrough which receives the liner dispensing opening fitment.

16. The liner sump dispensing system of claim 11 wherein the liner includes a dispensing opening fitment positioned closely adjacent said liner bottom wall and said container has an opening closely adjacent said container floor which receives the dispensing opening fitment therethrough, and wherein said trey has a front end proximal the liner dispensing opening fitment and a rear end distal the liner dispensing opening fitment, and wherein said linear reciprocating arm is coupled to said tray proximal said tray rear end.

17. The liner sump dispensing system of claim 16 wherein said tray floor tapers as it extends towards said trey front end.

18. The liner sump dispensing system of claim 17 wherein said trey wings taper in height from a highest height proximal said tray front end to a lowest height proximal said tray rear end.

19. The liner sump dispensing system of claim 11 wherein said linear reciprocating arm second portion includes a mounting flange which captures said container sidewall distal said container floor.

20. The liner sump dispensing system of claim 11 further comprising a cassette which receives said liner bottom end.

* * * * *